US008181374B2

(12) United States Patent
Stockdale

(10) Patent No.: US 8,181,374 B2
(45) Date of Patent: May 22, 2012

(54) SAFETY SIGN FOR SHOOTING HOUSES

(75) Inventor: Dale Stockdale, Ackley, IA (US)

(73) Assignee: Stockdale Gun Club, Ackley, IA (US)

( * ) Notice: Subject to any disclaimer, the term of this patent is extended or adjusted under 35 U.S.C. 154(b) by 0 days.

(21) Appl. No.: 12/143,970

(22) Filed: Jun. 23, 2008

(65) Prior Publication Data

US 2009/0313870 A1 Dec. 24, 2009

(51) Int. Cl.
*G09F 15/02* (2006.01)

(52) U.S. Cl. ..... 40/606.07; 40/606.14; 40/606.15

(58) Field of Classification Search ..... 40/606.07, 40/907, 599, 606.14, 606.15; 116/63 R, 116/303; 124/8; 42/1.01
See application file for complete search history.

(56) References Cited

U.S. PATENT DOCUMENTS

| | | | | | |
|---|---|---|---|---|---|
| 6,722 | A | * | 9/1849 | Doughty | 40/460 |
| 136,224 | A | * | 2/1873 | Duffield | 40/446 |
| 224,125 | A | * | 2/1880 | Baker | 40/446 |
| 227,403 | A | * | 5/1880 | Baker | 40/460 |
| 355,099 | A | * | 12/1886 | Potts | 40/460 |
| 394,140 | A | * | 12/1888 | Spicer | 40/460 |
| 823,782 | A | * | 6/1906 | Holden | 116/215 |
| 942,203 | A | * | 12/1909 | Haywood | 40/531 |
| 986,296 | A | * | 3/1911 | Kavanagh | 116/2 |
| 1,077,900 | A | * | 11/1913 | Ayer | 40/460 |
| 1,410,853 | A | * | 3/1922 | Tollenaar | 40/459 |
| 2,749,635 | A | * | 6/1956 | Robbins | 40/599 |
| 3,102,353 | A | * | 9/1963 | Kies | 40/617 |
| 4,829,687 | A | * | 5/1989 | Rumpf | 40/606.15 |
| 4,854,061 | A | * | 8/1989 | Khoshkish | 40/495 |
| 6,037,866 | A | * | 3/2000 | Leibowitz | 340/473 |
| 2010/0101483 | A1 | * | 4/2010 | Cossaboom | 116/303 |

* cited by examiner

*Primary Examiner* — Joanne Silbermann
*Assistant Examiner* — Christopher E Veraa
(74) *Attorney, Agent, or Firm* — The Davis Brown Law Firm; Kent A. Herink

(57) ABSTRACT

A safety sign for a shooting shed or building at a shotgun range is disclosed. The safety sign is mounted on the building and moveable between an exterior warning position wherein a warning sign is displayed and visible exterior of the building, warning shooters that it is not safe to shoot, and an interior warning position wherein the warning sign is visible inside the building and provides warning to occupants that it is not safe to exit the building. Preferably, the safety sign is mounted near the exit door of the building and partially obstructs the exit when in the interior warning position so as to provide further warning to occupants not to exit the building.

3 Claims, 6 Drawing Sheets

SAFETY SIGN FOR SHOOTING HOUSES

BACKGROUND OF THE INVENTION

The present invention relates generally to shooting houses and, more specifically, to a safety sign to be installed on shooting houses used to launch targets for shooters of shotguns that reduces the risk that a person operating the shooting house will be injured.

Shooting by shotgun of targets launched from machines stored in shooting houses is a popular sport. Shooters stand a specified distance behind the shooting houses. Targets are launched from the shooting houses in directions generally away from the shooter so that the shooter shoots generally in the direction of the shooting house. Obviously, the shooting houses protect persons manning the shooting houses from accidentally being shot. There are times, however, when the person manning the shooting house may be required to leave the safety of the shooting house while the range is in operation and becoming exposed to the shooters. Accidental shootings could occur if the shooters are aware that the person manning the shooting house may be exiting the shooting house and, further, if the person manning the shooting house can provide clear warning of the intention to leave the safety of the shooting house.

There is a need, accordingly, for a system that provides clear warning to shooters outside a shooting house that the person manning the shooting house may be exiting the shooting house and which also provides clear information to the person manning the shooting house that warning has not been given to the shooters that the person maiming the shooting house may be leaving the shooting house.

SUMMARY OF THE INVENTION

The present invention consists of a safety or warning sign for shotgun sport shooting houses that provides warning to shooters that a person inside the shooting house may be exiting the shooting house. The warning sign also provides notice to the person inside the shooting house that warning has been provided to the shooters that the person may be exiting the shooting house. A warning sign is mounted on a standard that is pivotable between a stored or interior warning position and an upper or exterior warning position. In the stored or interior position, the warning sign is preferably positioned in the vicinity of the exit door of the shooting house so that a person inside the shooting house would likely notice that the warning sign was in the stored or interior position and so not leave the shooting house. In the upper or exterior position, the warning sign would extend outside the confines of the shooting house so that it is visible to the shooters and would provide warning to them that the person inside the house may be intending to exit the shooting house. A secure mounting is provided that will reliably support the warning sign in the selected position.

DETAILED DESCRIPTION OF A PREFERRED EMBODIMENT

Figure 1:
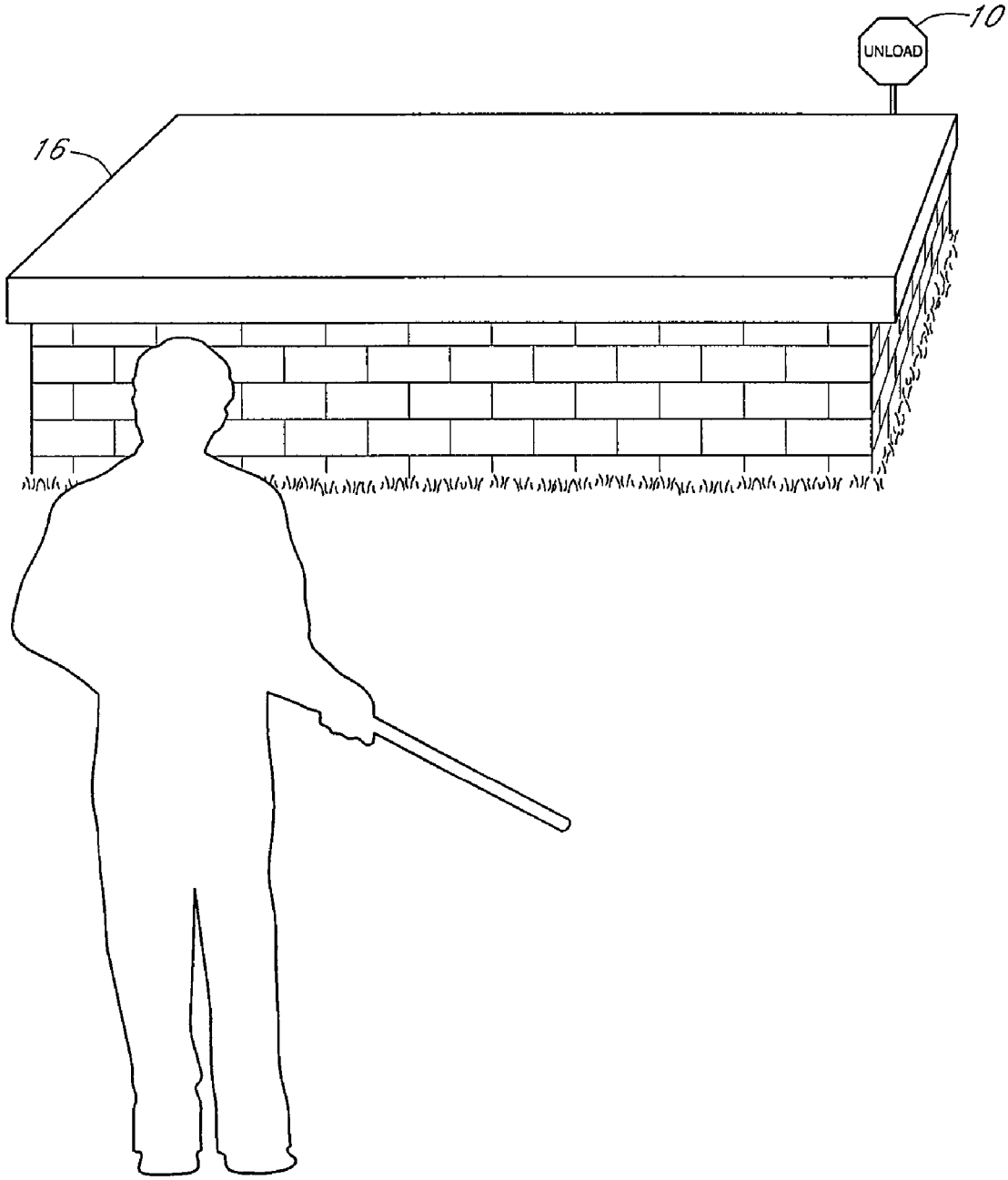
FIG. 1 is a perspective view of a shooting house from approximately the position of a shooter and showing the warning sign in the upper or exterior position.
Figure 2A:
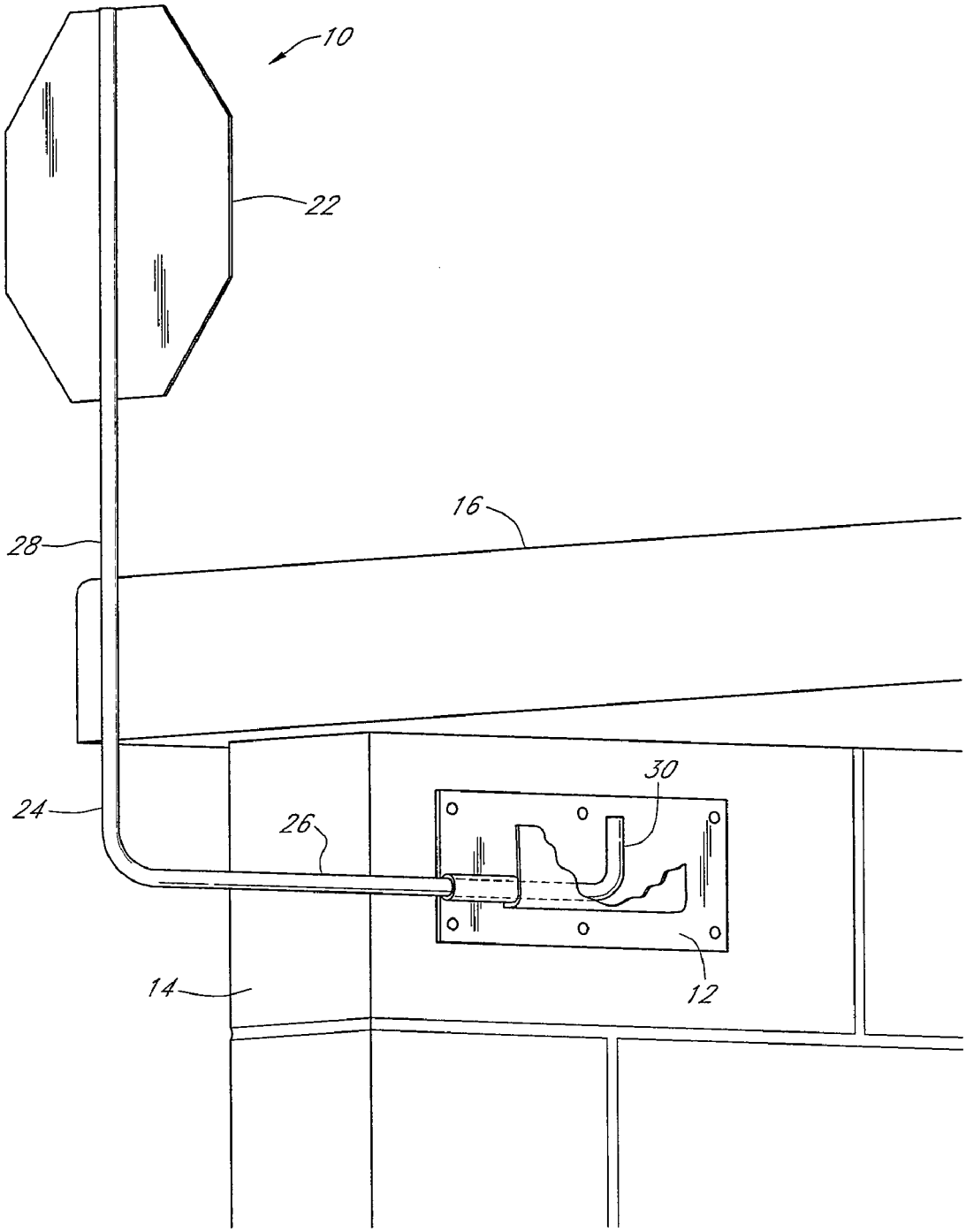
FIG. 2 is a side view of the present invention mounted adjacent the door of a shooting house with the warning sign in the upper or exterior position and with parts of the mounting bracket broken away to show the inner end of a standard which supports the warning sign.
Figure 2B:
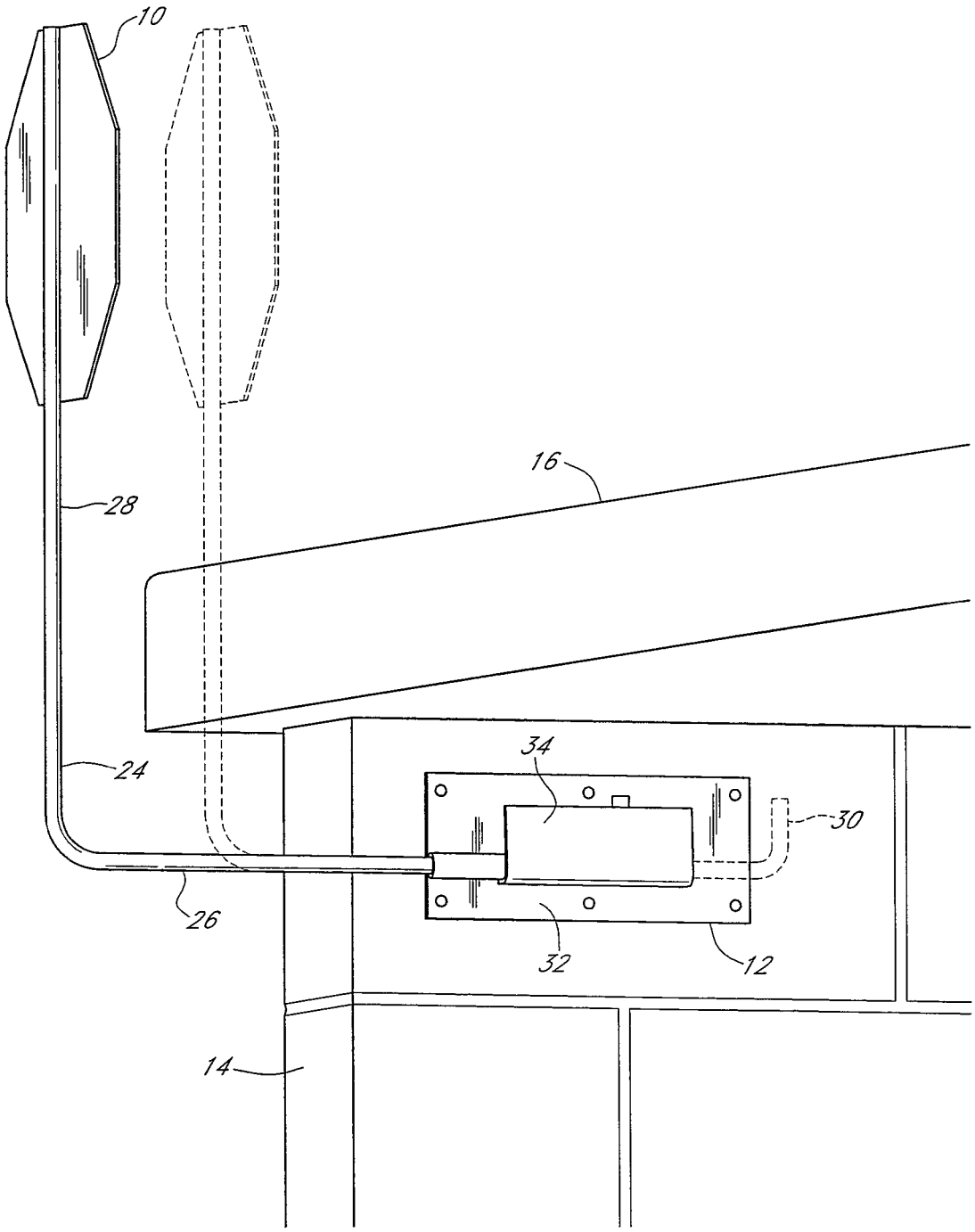

Illustrated in FIG. 2, generally at 10, is a safety sign of the present invention. Included is a mounting bracket 12 that is secured to a wall 14 of a shooting house (16 of FIG. 1), preferably near an exit doorway 18 of the shooting house 16, by a plurality of bolts 10 or the like. The safety sign 10 also includes a warning sign 22 that is mounted on the outer or distal end portion of a support arm or standard 24 that is of a generally reverse J-shaped configuration, having a horizontal middle portion 26, an outer portion 28 that extends transversely relative to the middle portion 26, and an inner or tail portion 30 that extends transversely relative to the middle portion 26 in the same direction as the outer portion 28, the middle portion 26 and tail portion 30 comprising the proximal end portion of the standard 24.

Figure 4:
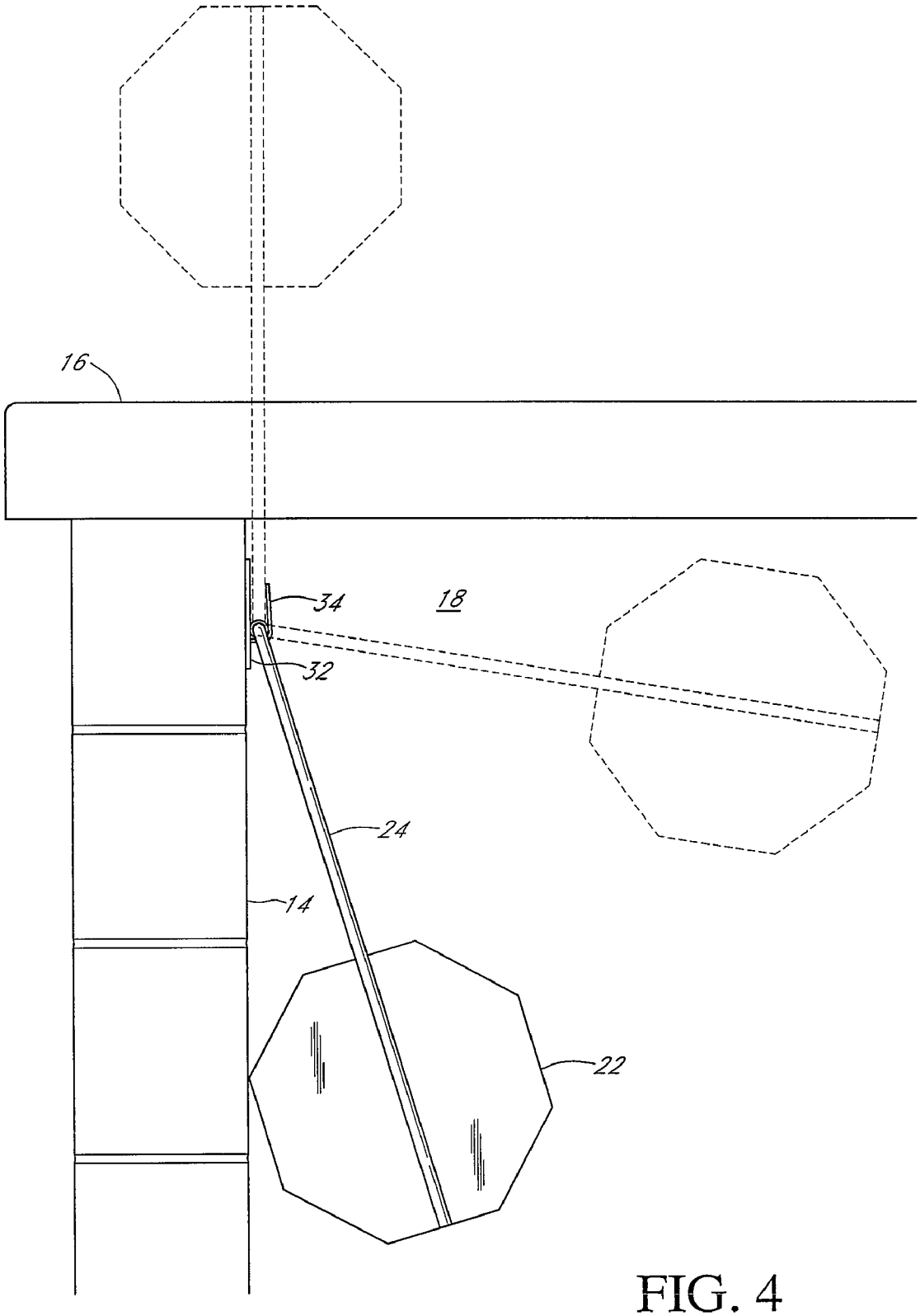
FIG. 4 is composite rear view showing the warning sign in its stored position and, in dotted line, movement to an intermediate position and to the upper position.
Figure 5:
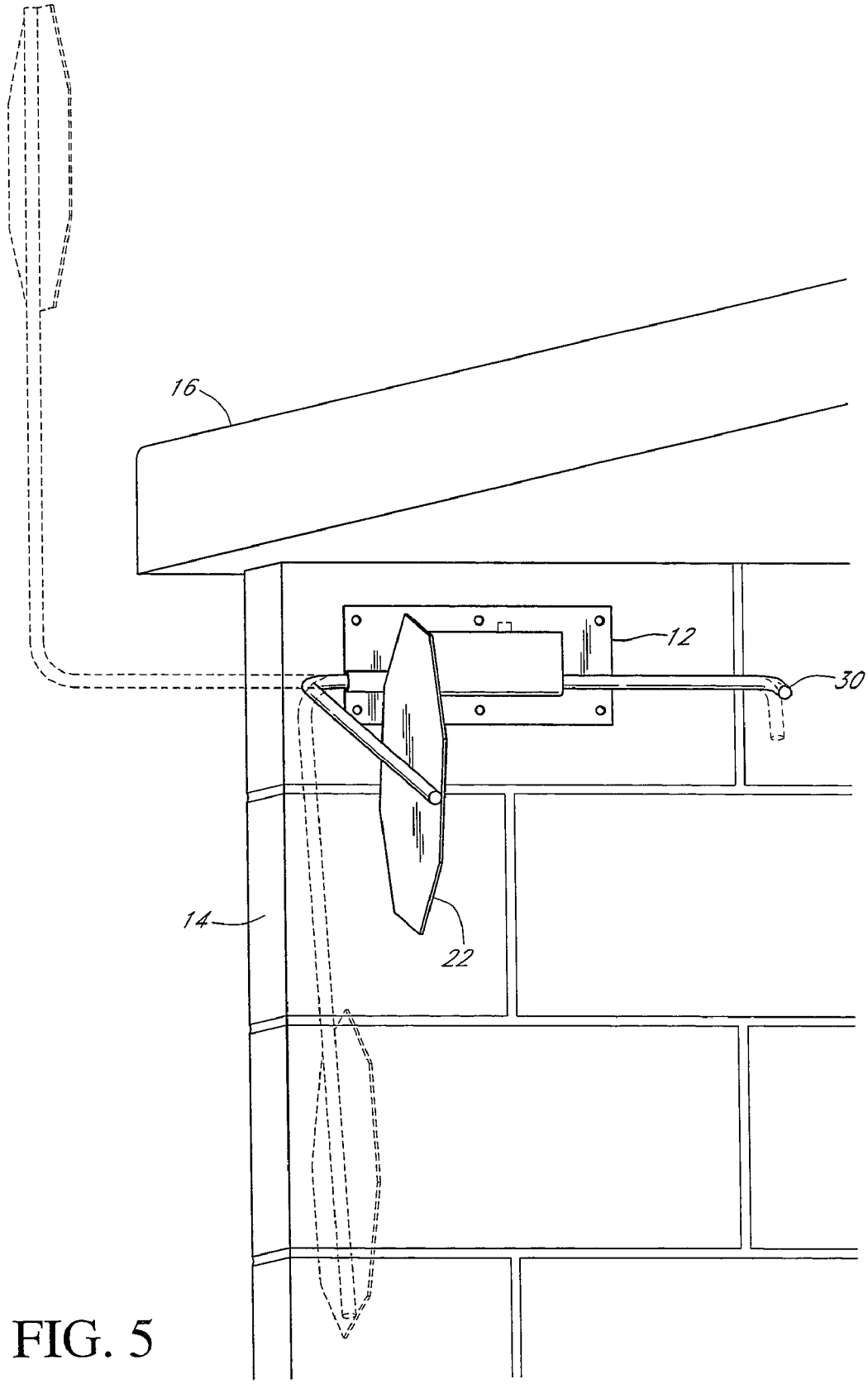
FIG. 5 is a side view corresponding to the intermediate position of FIG. 4.

The mounting bracket 12 includes a base plate 32 and an L-shaped flange 34 that is secured to the base plate 32 by weldments or the like (FIG. 4). The spacing between the base plate 32 and the upwardly extending portion of the L-shaped flange 34 is only slightly larger than the diameter of the middle portion 26 of the standard 24 so that the middle portion 26 is both pivotable at times, as will be explained in more detail below, and slideable longitudinally inside the mounting bracket 12.

When the safety sign 10 is in its upper or exterior position, as illustrated in FIGS. 1 and 2, the warning sign 22 is visible from the exterior of the building 16. The safety sign 10 can be secured in this position by sliding the standard 24 inside the mounting bracket to the position shown in FIG. 2 wherein the tail 30 is positioned between the L-shaped flange 34 and the base plate 32. In this position, the tail 30 is held in a vertical orientation by the base plate 32 and the L-shaped flange 34. The tail 30 and the mounting bracket 12 thereby combine to maintain the outer portion 28 of the standard 24 generally vertically so that the warning sign 22 is held at the upper or exterior position.

Figure 3:
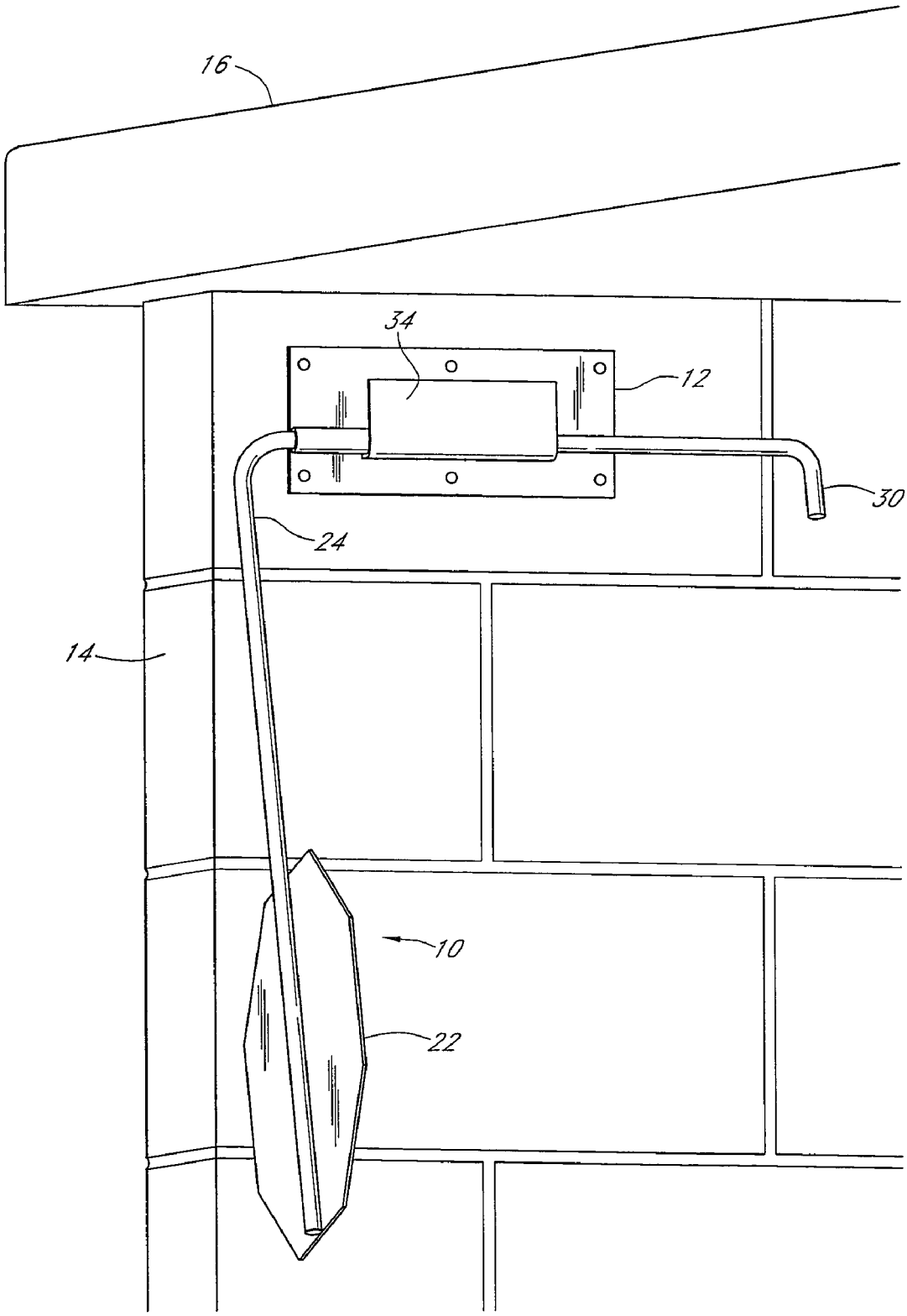
FIG. 3 is a side view of the present invention mounted adjacent the door of a shooting house with the warning sign the stored or interior position.

To lower the warning sign 22 from the upper position to the lower or interior position, the standard 24 is first moved by sliding the middle portion 26 inside the mounting bracket 12 until the tail 30 is located outside of the L-shaped flange 34. In this position, a user can pivot the safety sign 10 to the lower position by allowing the standard 24 to pivot inside the mounting bracket 12 until it reaches the position shown in FIG. 3. Movement of the safety sign 10 between the lower position, an intermediate position, and the upper position is shown in FIG. 4. It should be noted that in the interior or lower position of the safety sign 10, particularly as illustrated in solid line in FIG. 4, the warning sign 22 projects inside the wall 14 into the doorway 18. In this way, the warning sign 22 will be in an obtrusive position that will provide good warning to a person inside the shooting house 16 that the safety sign 10 is not in the exterior or warning position to give warning to shooters that may be present outside the shooting house 16.

The safety sign 10 will normally be in its exterior with the warning sign visible from outside the building 16. Users or occupants of the shooting house 16 will be instructed to lower the safety sign 10 to the interior position only when it is safe for shooters positioned outside the building 16 to shoot. Before the occupant of the building 16 leaves the building, the occupant will be instructed to raise the safety sign 10 to the exterior position so that the warning sign 22 is visible from outside the building and shooters outside the building will be warned that it is not safe to shoot. The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method.

The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

I claim:

1. A safety sign to be mounted adjacent a door on a shooting house manned by an operator for launching targets for sport shooting by people with guns, comprising:

(a) a single support arm having a distal end portion and a proximal end portion, said single support arm having a J-shape wherein the longer arm of the J-shape is the distal end portion and the short arm of the J-shape is the proximal end portion;

(b) a warning sign mounted on the distal end portion of the support arm;

(c) a mounting bracket attached to the interior of the shooting house adjacent the door and which receives the proximal end portion of the single support arm for movement of the support arm between an exterior position wherein the warning sign faces in a preselected direction and is visible by the people outside of the building to provide a warning against shooting of the guns and an interior position wherein the warning sign faces in the preselected direction is not visible by the people outside the building.

2. A safety sign as defined in claim 1, wherein the bracket comprises a tube in which is received the base arm of the J-shaped support arm for pivotal and sliding supported movement of the support arm between the interior and the exterior positions.

3. A safety sign as defined in claim 2, wherein the bracket comprises a flange which receives the short arm of the J-shaped support arm when in the exterior position to support the support arm in the exterior position.

* * * * *